US007900599B2

(12) United States Patent
Dittus et al.

(10) Patent No.: US 7,900,599 B2
(45) Date of Patent: Mar. 8, 2011

(54) METHOD FOR CONTROLLING AT LEAST ONE SHEATHED-ELEMENT GLOW PLUG IN AN INTERNAL COMBUSTION ENGINE AND ENGINE CONTROLLER

(75) Inventors: Bernd Dittus, Tamm (DE); Carsten Scholten, Stuttgart (DE); Rainer Moritz, Filderstadt (DE); Herbert Schumacher, Gerlingen (DE); Thilo Schedler, Rothenburg O.D. Tauber (DE)

(73) Assignee: Robert Bosch GmbH, Stuttgart (DE)

( * ) Notice: Subject to any disclaimer, the term of this patent is extended or adjusted under 35 U.S.C. 154(b) by 182 days.

(21) Appl. No.: 12/336,674

(22) Filed: Dec. 17, 2008

(65) Prior Publication Data

US 2009/0194070 A1 Aug. 6, 2009

(30) Foreign Application Priority Data

Feb. 4, 2008 (DE) ..... 10 2008 007 271

(51) Int. Cl.
*F23Q 7/00* (2006.01)

(52) U.S. Cl. ..... 123/406.55; 123/145 A; 123/142.5 E

(58) Field of Classification Search ..... 123/406.55, 123/142.5 E, 145 A
See application file for complete search history.

(56) References Cited

U.S. PATENT DOCUMENTS

| | | | | |
|---|---|---|---|---|
| 6,637,393 | B2 * | 10/2003 | Sutherland | 123/145 A |
| 2006/0021605 | A1 * | 2/2006 | Weber et al. | 123/527 |
| 2007/0240663 | A1 * | 10/2007 | Hiramatsu | 123/179.6 |
| 2007/0289571 | A1 * | 12/2007 | Petridis et al. | 123/305 |
| 2009/0012695 | A1 * | 1/2009 | Kernwein et al. | 701/102 |
| 2010/0126464 | A1 * | 5/2010 | Schumacher et al. | 123/350 |

* cited by examiner

*Primary Examiner* — Erick Solis
(74) *Attorney, Agent, or Firm* — Kenyon & Kenyon LLP

(57) ABSTRACT

A method for controlling at least one sheathed-element glow plug in an internal combustion engine, the temperature of the sheathed-element glow plug being controlled as a function of at least one operating parameter of the internal combustion engine in such a way that optimal combustion properties of the internal combustion engine prevail at all times.

15 Claims, 3 Drawing Sheets

METHOD FOR CONTROLLING AT LEAST ONE SHEATHED-ELEMENT GLOW PLUG IN AN INTERNAL COMBUSTION ENGINE AND ENGINE CONTROLLER

BACKGROUND INFORMATION

Sheathed-element glow plugs are usually used to heat up the combustion chambers when an internal combustion engine is started.

A sheathed-element glow plug is an electric heating element in the combustion chamber of an internal combustion engine. The sheathed-element glow plug is heated electrically only briefly at the start. The diesel fuel injected into the combustion chamber during a cold start of a diesel engine usually does not spontaneously ignite as smoothly as described in the theory of the diesel process.

For these reasons, an electrically heatable sheathed-element glow plug is inserted into the combustion chamber and is preheated in the startup phase. This is also known as preheating. The current required for this equals approximately 20 to 40 amperes per cylinder.

However, the diesel fuel injected into the combustion chamber during a cold start of a diesel engine does not usually spontaneously ignite as smoothly as described in the theory of the diesel process.

The reasons for this include the fact that the walls of the combustion chamber (cylinder walls, piston bottom) are still cold and have a high specific thermal capacity (iron material) while compressed air has a low thermal capacity. Therefore, the heat of compression is rapidly transferred to the cylinder walls and the piston base.

Another reason for this is that during startup, the piston speed is lower due to the electric starter motor (starter) and therefore there is more time for transfer of heat from the compressed air to the wall. Chamber engines in particular have a larger effective surface area, which absorbs heat from the gas. Starting a cold engine without sheathed-element glow plugs is possible above air temperatures of −10° C. in the case of direct injection, +30° C. in swirl chamber injection and approximately +60° C. in prechamber injection.

It is a disadvantage that when the engine is cold, compressed air may escape out of the combustion chamber past the piston rings, so that the final compression pressure and thus the final compression temperature turn out lower. These losses are further increased due to the lower piston speed during startup.

Another cause of the reduced combustion quality may be due to different fuel grades, in particular when the engine is flex-fuel-capable and is to burn fuels that are not easily ignitable.

FIG. 3 shows the structure of a closed-loop T regulation in combination with an open-loop T control, such as that known from the related art. An engine control EDC (electronic diesel control) is connected to a glow control unit GCU via an interface. A closed loop contained in the glow control unit GCU includes a temperature regulator TR, a resistance regulator RR, a sheathed-element glow plug output GP and a plug temperature model device TM, which are interconnected in this order. A first connecting loop P1 (path 1) is provided between the output of plug temperature model device TM and the input of temperature regulator TR.

A first subtraction circuit SI is provided at a connection point at the input of temperature regulator TR, temperature signals from both connections being input into this circuit More specifically, a temperature setpoint value $T_{setpoint}$ that is supplied to glow control unit GCU is applied to first subtraction circuit S1 and an actual temperature value $T_{actual}$ supplied by first connection loop P1 is also applied there. First subtraction circuit S1 calculates a temperature difference value ΔT from these two values and sends this temperature difference value ΔT to the input of temperature regulator TR.

Temperature regulator TR calculates a setpoint resistance value $R_{setpoint}$ and sends this setpoint resistance value $R_{setpoint}$ to a second subtraction circuit S2 connected between temperature regulator TR and resistance regulator RR. An actual resistance value $R_{actual}$ is sent via a second connecting loop P2 (path 2) to another input of second subtraction circuit S2. This actual resistance value $R_{actual}$ is calculated from the quotient of an effective voltage value $U_{eff}$ available at the output of resistance regulator RR and a measured current value $I_{measure}$ available at the output of sheathed-element glow plug GP.

Second subtraction circuit S2 calculates the difference between setpoint resistance value $R_{setpoint}$ and actual resistance value $R_{actual}$ and outputs a differential resistance value ΔR at the output. This differential resistance value ΔR is sent to resistance regulator RR. Actual temperature value $T_{actual}$ is available at the output of this closed control loop. It is inherent in this actual temperature value $T_{actual}$ that the modeled temperature of sheathed-element glow plug GP is not measured.

SUMMARY OF THE INVENTION

An object of the present invention is to provide a method which provides optimal combustion properties of an internal combustion engine while at the same time being inexpensive and easily implementable. It is also an object of the present invention to provide a corresponding engine controller.

This object is achieved by a method for controlling at least one sheathed-element glow plug in an internal combustion engine in which the temperature of the sheathed-element glow plug is controlled as a function of at least one operating parameter of the internal combustion engine in such a way that optimal combustion properties of the internal combustion engine prevail at all times.

An important point of the method according to the present invention is that in certain operating states, the combustion properties of the internal combustion engine reach an optimum and exhaust emissions are reduced significantly when the temperature of the sheathed-element glow plug is regulated as a function of operating parameters of the internal combustion engine.

According to this, an advantageous specific embodiment of the present invention provides for the at least one operating parameter to include a rotational speed of the internal combustion engine. Thus, emissions may be reduced significantly when there is a change in pressure, in particular when the engine cools down. White smoke and/or black smoke in the transition from coasting to normal driving operation may be reduced in particular. It has been found that the combustion chambers cool down during prolonged coasting or prolonged downhill driving when little or no fuel is being injected. If a large quantity of fuel is then injected, this is associated with increased emissions. This cooling is therefore counteracted by triggering of the sheathed-element glow plugs accordingly.

The at least one operating parameter preferably includes an injector quantity of fuel injected into the internal combustion engine. The glow process may be initialized here if the fuel quantity assumes a value of zero for a certain period of time.

The at least one operating parameter preferably includes a cooling water temperature. The glow process may be initialized here if the cooling water temperature is below a threshold value for a certain period of time.

The at least one operating parameter preferably includes an air pressure. The glow process may be initialized here when the air pressure supplied to the internal combustion engine is above and/or below a threshold value for a certain period of time.

The method is preferably performed in a glow control unit connected to the sheathed-element glow plug. The engine controller provides the glow control unit with information about when glowing is required or not allowed. Via a diagnostic line (interface), the glow control unit reports the errors detected by it, e.g., failure of a sheathed-element glow plug, to the engine controller.

Alternatively, the method is implemented in an engine control connected to the sheathed-element glow plug. The engine control receives electrical signals from sensors, analyzes them and calculates the trigger signals for the final control elements (actuators). The control program for this is stored as software in a memory. The program is executed by a microcontroller.

The engine control preferably receives a temperature change variable from the glow control unit via an interface. A change variable is calculated in the engine control here. Only change variables are then input via the interface. Otherwise a previous value is taken up by the glow control unit and the sheathed-element glow plugs are triggered using this value. In this case, the change variable is calculated from a slow component from a regulator and a fast component from a controller.

The at least one temperature change variable is preferably differentiated by characteristic bits at the interface. This reduces the data volume required for the calculation.

The object defined above is achieved by an engine controller for an internal combustion engine having a control unit for controlling the temperature of at least one sheathed-element glow plug, the engine controller being designed in such a way that the temperature of the sheathed-element glow plug is controllable as a function of at least one operating parameter of the internal combustion engine, so that optimal combustion properties of the internal combustion engine prevail at all times.

An important point of the engine controller according to the present invention is that the combustion properties of the internal combustion engine reach an optimum in certain operating states and exhaust emissions are greatly reduced when the temperature of the sheathed-element glow plug is regulated as a function of operating parameters of the internal combustion engine.

DETAILED DESCRIPTION

Figure 1:
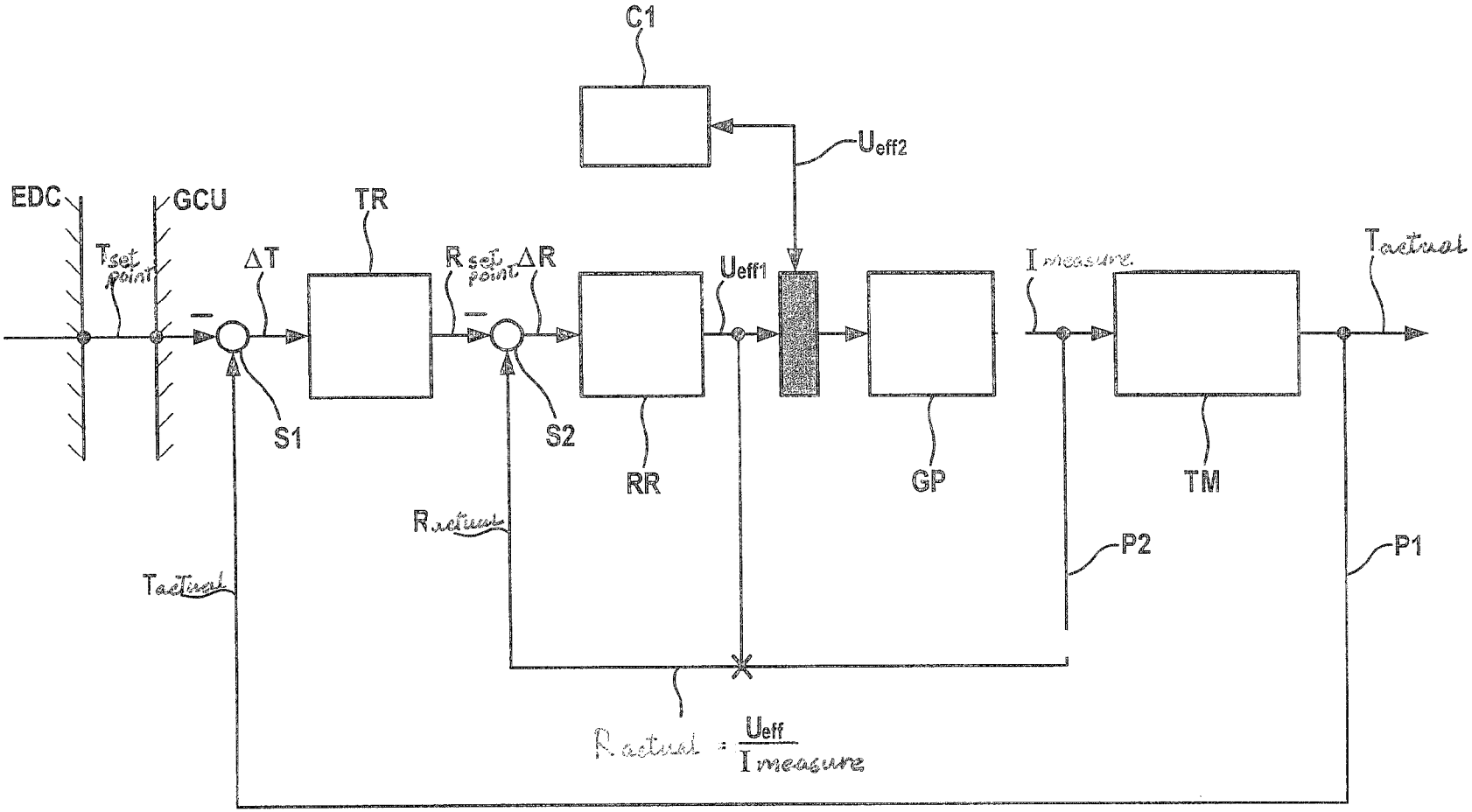
FIG. 1 shows a closed-loop T regulation in combination with an open-loop T control in one specific embodiment of the present invention.

FIG. 1 shows the design of closed-loop T regulation in combination with an open-loop T control in an exemplary specific embodiment of the present invention. An engine control EDC is connected via an interface to a glow control unit GCU. A closed regulating loop contained in the glow control unit GCU includes a temperature regulator TR, a resistance regulator RR, a sheathed-element glow plug GP and a plug temperature model device TM, which are interconnected in this order. A first connecting loop P1 is provided between the output of plug temperature model device TM and the input of temperature regulator TR.

A first subtraction circuit S1 into which temperature signals from both connecting lines are entered is connected at the connecting point at the input of temperature regulator TR. More precisely, a setpoint temperature value $T_{setpoint}$ sent to glow control unit GCU and an actual temperature value $T_{actual}$ sent to first connecting loop P1 are applied to first subtraction circuit S1. First subtraction circuit S1 uses these two values to calculate a differential temperature value $\Delta T$ and sends this differential temperature value $\Delta T$ to the input of temperature regulator TR.

Temperature regulator TR calculates a setpoint resistance value $R_{setpoint}$ and sends this setpoint resistance value $R_{setpoint}$ to a second subtraction circuit S2 connected between temperature regulator TR and resistance regulator RR.

An actual resistance value $R_{actual}$ is sent to another input of second subtraction circuit S2 via a second connecting loop P2. This actual resistance value $R_{actual}$ is calculated from the quotient of an effective total voltage value $U_{eff}$ formed by addition of a first effective voltage value $U_{eff1}$ and a second effective voltage value $U_{eff2}$ and a measured current value $I_{measure}$ applied to the output of sheathed-element glow plug GP.

First effective voltage value $U_{eff1}$ here is applied to the output of resistance regulator RR. Second effective voltage value $U_{eff2}$ is obtained from a controller C1 in response to operating parameters based on a rotational speed of the internal combustion engine, for example, and/or an injector quantity of fuel injected into the internal combustion engine and/or a cooling water temperature and/or an air pressure. Second effective voltage value $U_{eff2}$ is calculated here from:

$$U_{eff\,2} = \frac{d(U_{eff_aus}control)}{dt} * t$$

Actual resistance value $R_{actual}$ is thus calculated from:

$$R_{actual} = \frac{U_{eff}}{I_{measure}},$$

where it holds that: $U_{eff}=U_{eff1}+U_{eff2}$.

Second subtraction circuit S2 calculates the difference between setpoint resistance value $R_{setpoint}$ and actual resistance value $R_{actual}$ and outputs a differential resistance value $\Delta R$ at the output. This differential resistance value $\Delta R$ is sent to resistance regulator RR.

Actual temperature value $T_{actual}$ is applied to the output of this closed control loop.

Figure 2:
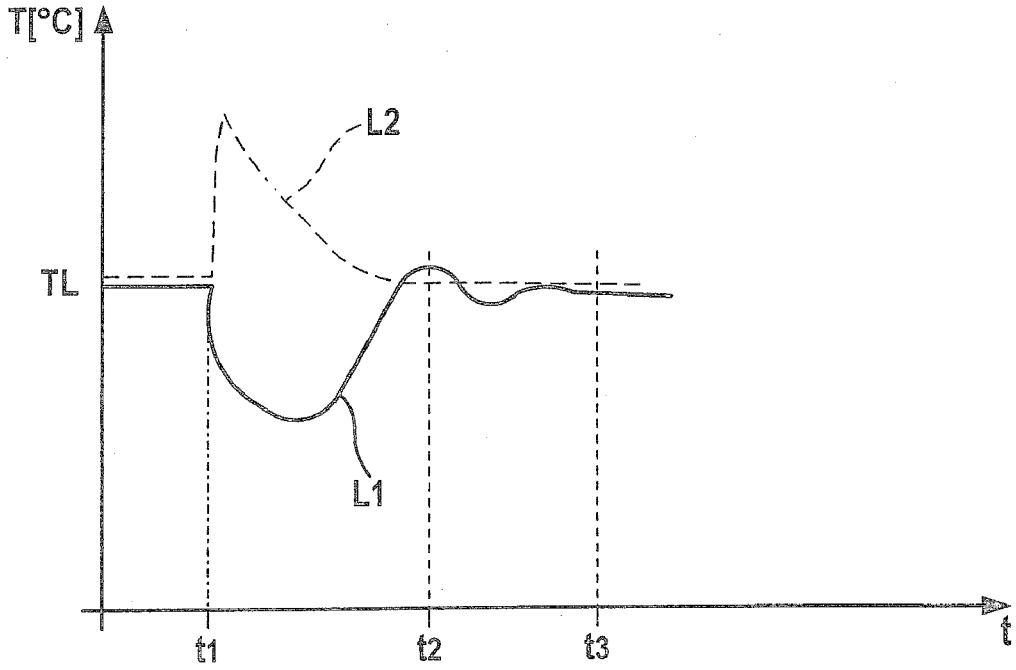
FIG. 2 shows a curve to illustrate the temperature curve of the sheathed-element glow plug over time.
Figure 3:
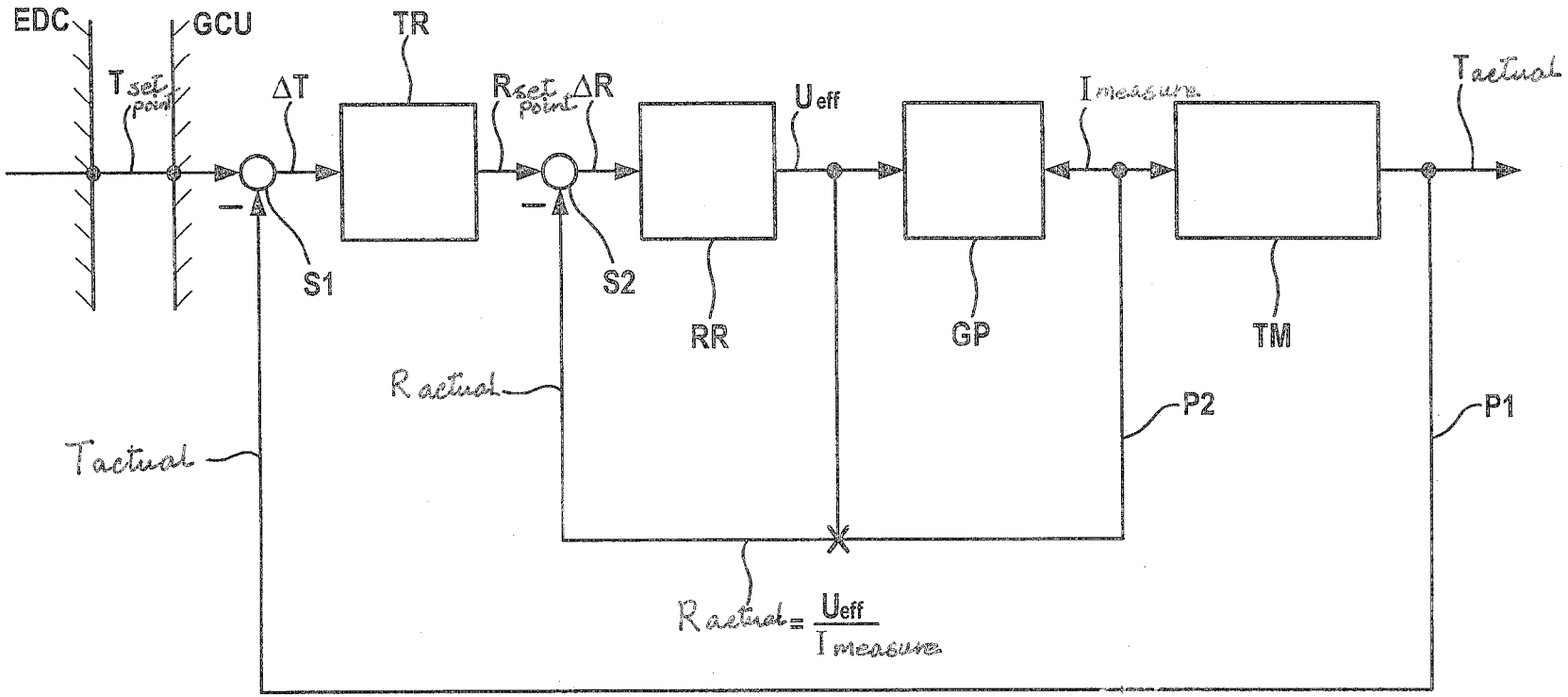
FIG. 3 shows a closed-loop T regulation in combination with an open-loop T control such as that known from the related art.

FIG. 2 shows a curve to illustrate the temperature characteristic of sheathed-element glow plug GP over time. Solid line L1 here represents the curve of actual temperature value $T_{actual}$ over time. Actual temperature value $T_{actual}$ is measured here rather than being modeled. Actual temperature value $T_{actual}$ runs at a steady constant temperature level TL until time t1. At point in time t1, actual temperature value $T_{actual}$ undergoes a sudden change because of an interference variable due to an injector quantity, a rotational speed or both, for example. Actual temperature value $T_{actual}$ thus oscillates greatly over time and has reached a steady state at temperature level TL only after a time t3.

However, dashed line L2 shows the curve of setpoint temperature value $T_{setpoint}$ over time. Setpoint temperature value $T_{setpoint}$ also runs at a steady constant temperature level TL until time t1. At point in time t1, the curve of setpoint temperature value $T_{setpoint}$ also undergoes a sudden change because of an interference variable due to an injector quantity, a rotational speed or both, for example. This change is in the opposite direction from the change in the curve of actual temperature value $T_{actual}$. In contrast with the curve of actual temperature value $T_{actual}$, the curve of setpoint temperature value $T_{setpoint}$ rapidly approaches temperature level TL without any oscillation at point in time t2, t2 being smaller than t3. The inertia of the regulator is compensated here by the sudden change in setpoint temperature value $T_{setpoint}$ in engine control EDC.

There is a special advantage in the fact that no data, in particular the rotational speed of the internal combustion engine, the injector quantity, etc., need be transferred between engine control EDC and glow control unit GCU via the interface. This saves on computation capacities, which in turn brings a cost advantage.

What is claimed is:

1. A method for controlling at least one sheathed-element glow plug in an internal combustion engine, comprising:

controlling a temperature of the sheathed-element glow plug as a function of at least one operating parameter of the internal combustion engine, so that optimal combustion properties of the internal combustion engine prevail at all times, wherein the at least one operating parameter includes at least one of a rotational speed of the internal combustion engine, an injector quantity of fuel injected into the internal combustion engine, a cooling water temperature, and an air pressure.

2. The method according to claim 1, wherein the method is performed in a glow control unit which is connected to the sheathed-element glow plug.

3. The method according to claim 1, wherein the method is performed in an engine control connected to the sheathed-element glow plug.

4. The method according to claim 3, further comprising:

sending at least one temperature change variable from a glow control unit to the engine control via an interface.

5. The method according to claim 4, wherein the at least one temperature change variable is differentiated by characteristic bits at the interface.

6. An engine controller for an internal combustion engine, comprising:

a control unit for controlling a temperature of at least one sheathed-element glow plug, the temperature of the sheathed-element glow plug being controllable as a function of at least one operating parameter of the internal combustion engine in such a way that optimal combustion properties of the internal combustion engine prevail at all times, wherein the at least one operating parameter includes at least one of a rotational speed of the internal combustion engine, an injector quantity of fuel injected into the internal combustion engine, a cooling water temperature, and an air pressure.

7. The engine controller according to claim 6, wherein the control unit is connected to the sheathed-element glow plug.

8. The engine controller according to claim 7, wherein at least one temperature change variable is sent from the control unit to the engine controller via an interface.

9. The engine controller according to claim 8, wherein the at least one temperature change variable is differentiated by characteristic bits at the interface.

10. The engine controller according to claim 3, wherein the sheathed-element glow plugs are triggered during at least one of prolonged coasting and downhill driving, wherein at least one temperature change variable is sent from a glow control unit to the engine control via an interface, wherein detected sheathed-element glow plug errors are reported to the engine controller, wherein the at least one temperature change variable is differentiated by characteristic bits at the interface, and wherein the glow process is initialized if the fuel quantity is zero for a predetermined period of time.

11. The method according to claim 1, further comprising:

triggering the sheathed-element glow plugs during at least one of prolonged coasting and downhill driving.

12. The method according to claim 1, wherein the glow process is initialized if the fuel quantity is zero for a predetermined period of time.

13. The method according to claim 1, further comprising:

reporting detected sheathed-element glow plug errors to the engine controller.

14. The method according to claim 4, wherein at least one temperature change variable is differentiated by characteristic bits at the interface.

15. The method according to claim 3, further comprising:

triggering the sheathed-element glow plugs during at least one of prolonged coasting and downhill driving;

sending at least one temperature change variable from a glow control unit to the engine control via an interface;

reporting detected sheathed-element glow plug errors to the engine controller;

wherein the at least one temperature change variable is differentiated by characteristic bits at the interface, and wherein the glow process is initialized if the fuel quantity is zero for a predetermined period of time.

* * * * *